US009696050B2

(12) United States Patent
McGarva et al.

(10) Patent No.: US 9,696,050 B2
(45) Date of Patent: Jul. 4, 2017

(54) EVAPORATIVE HUMIDIFIER AND INDOOR CLIMATE CONTROLLING SYSTEM COMPRISING THE SAME

(71) Applicant: KONINKLIJKE PHILIPS N.V., Eindhoven (NL)

(72) Inventors: John Robert McGarva, Eindhoven (NL); Emma Sandberg, Eindhoven (NL); Lei Tao Chen, Eindhoven (NL); Zhiyoung Dai, Eindhoven (NL); Jean Bart Bleeker, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 95 days.

(21) Appl. No.: 14/410,243

(22) PCT Filed: Jun. 17, 2013

(86) PCT No.: PCT/IB2013/054947
§ 371 (c)(1),
(2) Date: Dec. 22, 2014

(87) PCT Pub. No.: WO2014/001952
PCT Pub. Date: Jan. 3, 2014

(65) Prior Publication Data

US 2015/0338119 A1 Nov. 26, 2015

(30) Foreign Application Priority Data

Jun. 28, 2012 (WO) ..... PCT/CN2012/000887

(51) Int. Cl.
*F24F 11/00* (2006.01)
*F24F 6/04* (2006.01)
(Continued)

(52) U.S. Cl.
CPC ..... *F24F 6/043* (2013.01); *F24F 11/0008* (2013.01); *F24F 13/06* (2013.01); *F24F 2006/008* (2013.01)

(58) Field of Classification Search
CPC ..... F24F 6/00; F24F 6/043; F24F 11/0008; F24F 13/06; F24F 2006/008
(Continued)

(56) References Cited

U.S. PATENT DOCUMENTS 3,864,437 A 2/1975 Blaszkowski
4,865,775 A * 9/1989 Steiner ..... F24F 6/043 261/120
(Continued)

FOREIGN PATENT DOCUMENTS

JP 2002081718 A 3/2002
JP 2006170460 A 6/2006
(Continued)

*Primary Examiner* — Charles Bushey

(57) ABSTRACT

The invention relates to an evaporative humidifier including a water reservoir, a wick unit and a fan unit. The wick unit is configured to absorb water from the water reservoir. The fan unit is arranged within a fan housing and configured to force an air flow to flow through the wick unit. The fan housing comprises a top cover unit defining at least one annular air outlet at an outer part adjacent a circumference of the top cover unit. One of the main advantages of this invention is that the evaporative humidifier has an optimal air flow path and can operate in a low noise. The invention also relates to an indoor climate controlling system using such an evaporative humidifier.

11 Claims, 5 Drawing Sheets

(51) Int. Cl.
*F24F 13/06* (2006.01)
*F24F 6/00* (2006.01)

(58) Field of Classification Search
USPC ..... 261/104, 107, DIG. 65
See application file for complete search history.

(56) References Cited

U.S. PATENT DOCUMENTS 5,034,162 A * 7/1991 Chiu ..... F24F 6/043 261/107
5,133,904 A 7/1992 Pepper
5,143,656 A * 9/1992 Marino ..... F24F 6/043 261/107
5,573,713 A * 11/1996 Tomasiak ..... F24F 1/00 261/120
6,592,107 B1 7/2003 Wong
6,622,993 B2 9/2003 Mulvaney
6,796,550 B2 9/2004 Mulvaney
7,073,782 B2 * 7/2006 French ..... F24F 6/043 261/100
2002/0180071 A1 12/2002 Stanek
2004/0012103 A1 * 1/2004 Mulvaney ..... F24F 6/043 261/72.1
2009/0314164 A1 * 12/2009 Yamashita ..... F24F 3/1603 96/245
2011/0179813 A1 7/2011 Fan
2015/0084215 A1 * 3/2015 Ojeda ..... F24F 6/043 261/71

FOREIGN PATENT DOCUMENTS

JP 2007057171 A 3/2007
JP 4854797 B2 1/2012

* cited by examiner

EVAPORATIVE HUMIDIFIER AND INDOOR CLIMATE CONTROLLING SYSTEM COMPRISING THE SAME

This application is the U.S. National Phase application under 35 U.S.C. §371 of International Application No. PCT/IB2013/054947, filed on Jun. 17, 2013, which claims the benefit of International Application No. PCT/CN2012/000887 filed on Jun. 28, 2012. These applications are hereby incorporated by reference herein.

FIELD OF THE INVENTION

The present invention relates generally to an evaporative humidifier and an indoor climate controlling system using such an evaporative humidifier.

BACKGROUND

A humidifier is an appliance that increases humidity (moisture) in a single room or in an entire house.

The most commonly used humidifier is an evaporative or wick humidifier including a water reservoir, a wick immersed in water and a fan adjacent to the wick. The reservoir is a containing tank of water filled prior to and/or during operation and provides water for a moisture output. The wick is a water screen, a water absorbing medium or a filter that absorbs water from the reservoir. The fan creates an air flow which passes through the wick and carries moisture into the room, thus aiding in the evaporation of the water within the wick and the enhancement of humidity.

For evaporative efficiency requirements, a traditional evaporative humidifier usually includes a large fan arranged in a fan housing and corresponding large-area grilles extending almost entirely over a rotary plane of the fan for redirecting the humidified air out of the humidifier. This traditional evaporative humidifier has a disadvantage of not allowing for a large user interface arrangement since an upper surface of the evaporative humidifier is at large occupied by the grille. Moreover, the large-area grilles or other attempts to redirect the humidified air at an edge of the fan to a middle of the fan will increase the pressure drop of the fan housing, reduce the efficiency of the fan and result in a loud noise of the fan, thus lowering the efficiency rating of the evaporative humidifier.

Accordingly, there is a need of a new evaporative humidifier with improved air flow path and efficiency rating.

SUMMARY OF THE INVENTION

The invention aims at totally or partly overcoming one or more of the drawbacks mentioned above.

According to some embodiments, it is provided an evaporative humidifier comprising a water reservoir, a wick unit and a fan unit. The wick unit is configured to absorb water from the water reservoir. The fan unit is arranged within a fan housing and configured to force an air flow to flow through the wick unit. The fan housing comprises a top cover unit defining at least one annular air outlet at an outer part adjacent a circumference of the top cover unit. The annular air outlet allows a larger central user interface unit (UI), which could be well received by a user. In addition, when user is manipulating the UI by hand, his/her wrists can feel the strength of the air flow intuitively, such that the user can control the humidification rate even he/she cannot see an indicator thereof (e.g., in case the user is blind, or something blocks his/her view, etc.)

According to an example of the invention, a bottom wall of the top cover unit has an overall shape of an aerodynamic design for directing air in the fan housing to flow toward the annular air outlet when the fan rotates.

According to an example of the invention, the aerodynamic design is a streamline design of a convex shape, such as substantially U shape, substantially V shape or substantially trapezoid shape.

According to an example of the invention, a large-area user interface unit is mounted on the top cover unit and surrounded by the annular air outlet. With this UI surrounded by the annual air outlet, the user can feel the air coming out by his/her wrist, which can be a very convenient way for the user to feel better the strength of the outgoing airflow, alternatively or additionally, he/she can also look at an indicator (e.g., LED) on the UI which gives an visual indication of the strength of the airflow. In an embodiment of the invention, a stronger airflow brings a higher humidification rate and vice versa.

According to an example of the invention, the wick unit comprises a wick, a wick holder for mounting the wick and a float arranged in the wick holder for associating with a water level in the water reservoir and wherein the fan unit comprises a motor and an actuator for actuating the motor, in operation the float is such arranged in the wick holder that the float is guided by the wick holder and buoyed by the water in the water reservoir so that the operation of the evaporative humidifier is controlled based on, at least in part, the water level in the water reservoir.

According to an example of the invention, the actuator is configured to remain the motor running for a period of time after the water level is below a water level threshold and then stop the motor.

According to an example of the invention, the actuator may be: a sensor-based actuator, which actuates the motor if the sensed height of the float is up to or higher than a predetermined height; or a contact component, which actuates the motor if the float collides the contacting component.

According to an example of the invention, the wick and/or the float can be removed from the wick holder for easily cleaning.

According to an example of the invention, the wick holder forms a substantially vertical guide along which the float is configured to move.

According to an example of the invention, the float in operation can float a displacement in the range of several millimeters.

According to an example of the invention, the float clicks into the wick holder.

According to an example of the invention, the wick holder is heavy enough not to float when it experiences a buoyancy force from the float.

According to an example of the invention, a humidity sensor for sensing an external air humidity of the room is such arranged on an outer housing of the evaporative humidifier that it is separated from and not interfered by freshly humidified outgoing air.

According to an example of the invention, the evaporative humidifier further comprises a program control unit configured to ensure that sensing the external air humidity is only performed after the fan unit has been operating for a first period of time and/or the reading of the sensed external air humidity is frozen for a second period of time after the fan unit stops operating so as not to confuse the user by a sharply increment of the reading caused by the humidified air inside the evaporative humidifier.

According to another example of the invention, the first and/or the second period of time is 10 minutes.

According to still another example of the invention, the program control unit is further configured to automatically actuate the fan unit when the sensed external air humidity is lower than a preset humidity.

The present invention also provides an indoor climate controlling system comprising the aforementioned evaporative humidifier and a main control unit coupled to the evaporative humidifier, wherein the main control unit is configured to automatically control the operation of the evaporative humidifier.

Other objects, advantages, specific effects and novel features of an evaporative humidifier of this type shall be described in greater detail hereunder with reference to a preferred embodiment of the invention. However, it should be understood that the concepts at the basis of the invention may advantageously be used also in humidifier of other type, which uses an air exhausting system which forces air flow through a wick.

DETAILED DESCRIPTION OF THE PRESENT INVENTION

Figure 1:
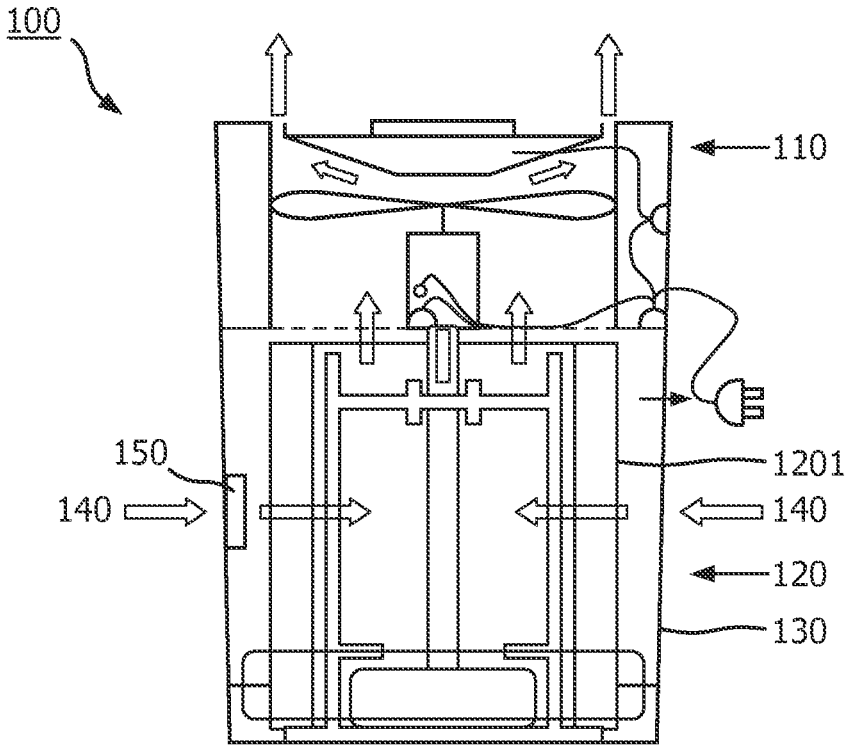
FIG. 1 is a schematic structural view of an evaporative humidifier 100 in an assembled state according to an example of the present invention.
Figure 2:
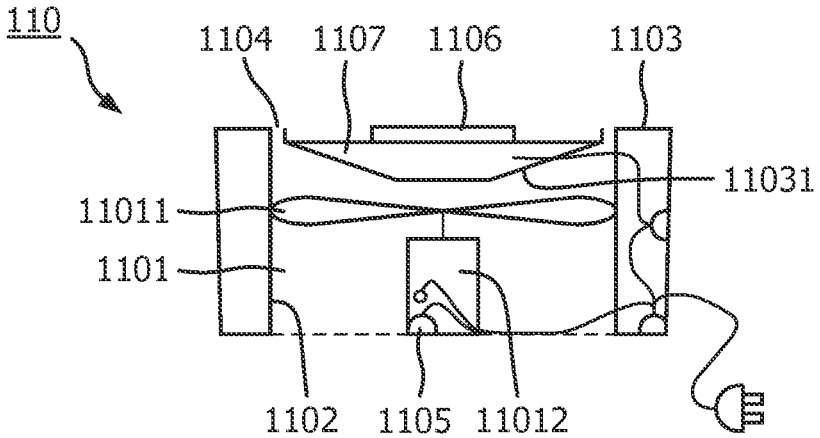
FIG. 2 is a schematic structural view of an upper portion 110 of the evaporative humidifier 100 in FIG. 1.
Figure 3:
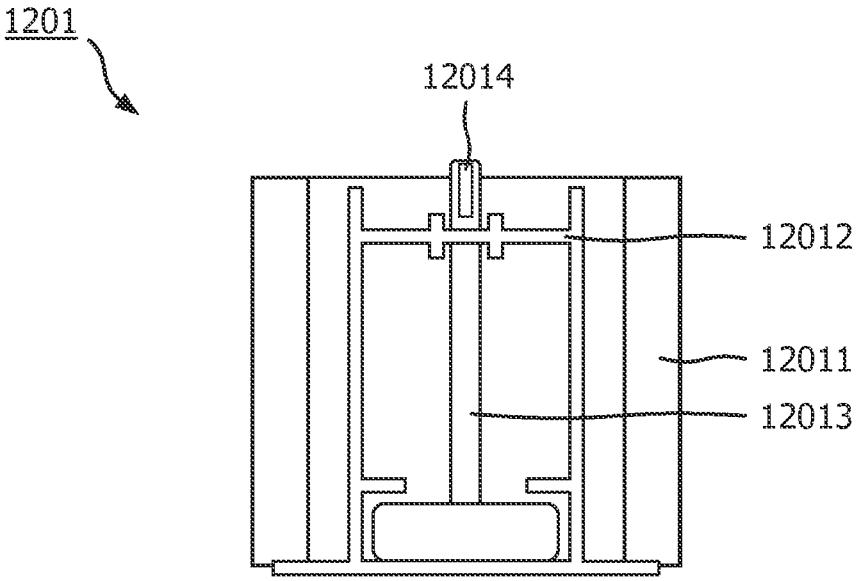
FIG. 3 is a schematic structural view of a wick unit 1201 in a lower portion 120 of the evaporative humidifier 100 in FIG. 1.
Figure 4:
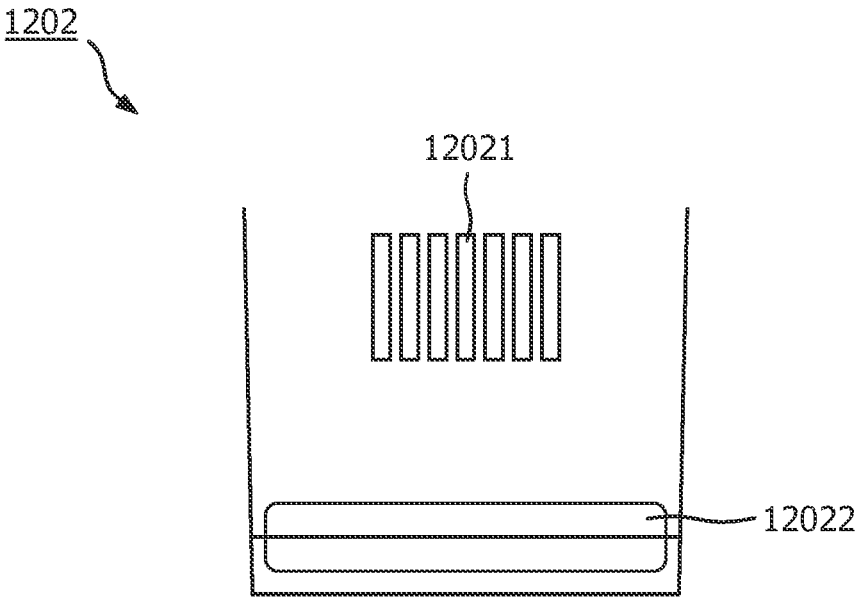
FIG. 4 is a schematic structural view of a water reservoir 1202 in the lower portion 120 of the evaporative humidifier 100 in FIG. 1.

Now refer to FIGS. 1-4, an evaporative humidifier 100 according to an embodiment of the present invention comprises an upper portion 110 and a lower portion 120. A fan unit 1101 is arranged in the upper portion 110 while a water reservoir 1202 and a wick unit 1201 are arranged in the lower portion 120. The wick unit 1201 is configured to absorb water from the water reservoir 1202 and the fan unit 1101 is arranged within a fan housing 1102 and configured to force an air flow to flow through the wick unit 1201.

The fan unit 1101 includes a fan 11011, an electric motor 11012 and an actuator 1105 for actuating the motor 11012. The fan housing 1102 comprises a top cover unit 1103 defining at least one annular air outlet 1104 at an outer part adjacent a circumference of the top cover unit 1103. A bottom wall 11031 of the top cover unit 1103 has an overall shape of an aerodynamic design for directing air in the fan housing 1102, e.g., at the center of the fan housing 1102, to flow toward the annular air outlet 1104 when the fan 11011 rotates. The aerodynamic design is a streamline design of a convex shape, such as a substantially U shape, substantially V shape or substantially trapezoid shape. A large-area user interface (UI) unit having a UI 1106 and a control circuit 1107 for controlling the display of the UI 1106 is mounted on the top cover unit 1103 and surrounded by the annular air outlet 1104. With this UI 1106 surrounded by the annual air outlet 1104, the user can feel the air coming out by his/her wrist, which can be a very convenient way for the user to feel better the strength of the outgoing airflow, in addition to looking at an indicator (LED) of the UI 1106.

The wick unit 1201 comprises a wick 12011, a wick holder 12012 for mounting the wick 12011 and a float 12013 arranged in the wick holder 12012 for associating with a water level in the water reservoir 1202. In operation the float 12013 is such arranged in the wick holder 12012 that it is buoyed by the water in the water reservoir 1202 so that the operation of the evaporative humidifier 100 is controlled based on, at least in part, the water level in the water reservoir 1202. The wick holder 12012 forms a substantially vertical guide along which the float 12013 is configured to move.

The actuator 1105 is configured to remain the motor running for a period of time after the water level is below a water level threshold and then stop the motor. The actuator 1105 may be: a sensor-based actuator, which actuates the motor if the sensed height of the float is up to or higher than a predetermined height; or a contact component (for instance a contact switch), which actuates the motor 11012 if the float 12013 (for instance its ball-shaped tip portion 12014) collides the contacting component.

The wick 12011 and/or the float 12013 can be removed from the wick holder 12012 for easily cleaning. The float 12013 in operation can float a displacement in the range of several millimeters, for instance 5-100 mm. Preferably, the float 12013 clicks into the wick holder 12012 and the wick holder 12012 is heavy enough not to float when it experiences a buoyancy force from the float 12013.

A humidity sensor 150 (shown in FIG. 1) for sensing an external air humidity out of the humidifier is such arranged on an outer housing 130 of the evaporative humidifier 100 that it is separated from and not interfered by freshly humidified outgoing air. Concretely and exemplarily, the humidity sensor 150 may be arranged in a pathway with one side having small holes to let the external air enter and the other side connected to a negative pressure side of the fan. A nonreturn component, e.g., a check valve or a nonreturn flap, may be arranged within the pathway for preventing the air flow from returning, thus the humidified air at negative pressure side of the fan will not impact the accurate reading of the sensor.

The water reservoir 1202 includes an air inlet grille 12021 allowing outer air to flow into the water reservoir 1202 and a viewing window 12022 for user to observe the water level in the water reservoir 1202 straightforward.

Figure 7:
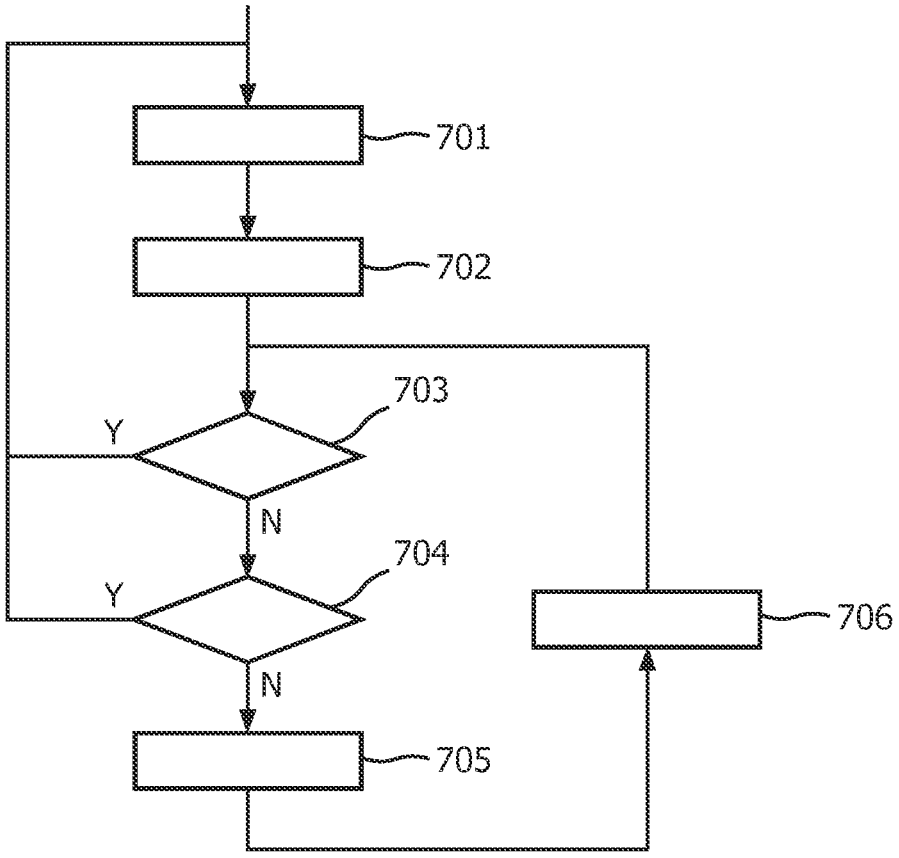
FIG. 7 is a schematic block diagram showing a method for controlling a humidity display according to the present invention.
Figure 8:
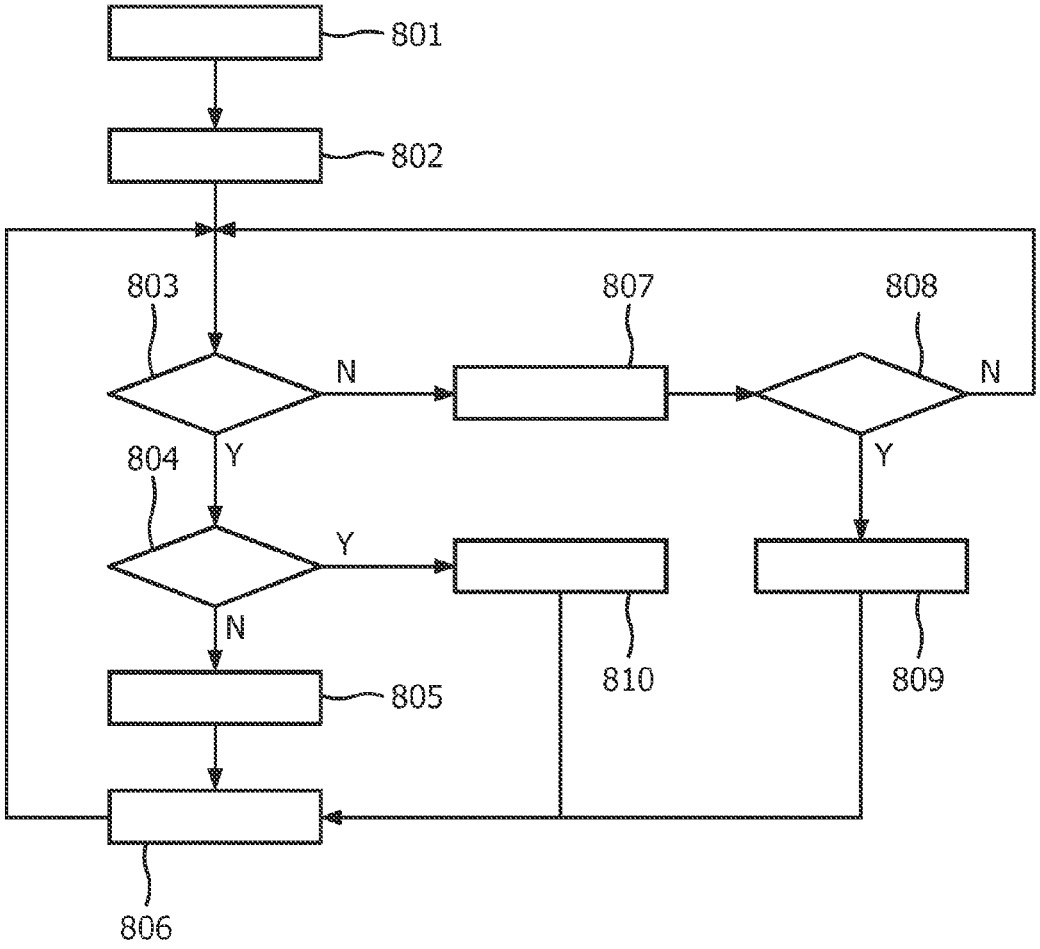
FIG. 8 is a schematic block diagram showing a method for controlling the rotation of a fan according to the present invention.

As shown in FIGS. 7-8, in order to ensure the accurate reading of the humidity sensor, a software algorithm may adopted to ensure that the reading is only displayed/used after the fan has been operating for a fixed period of time. This ensures that unhumidified external air is drawn over the sensor and an accurate reading is provided. If the fan has stopped, the humid air inside the product can cause the reading on the humidity sensor to rise. The software can also temporarily freeze the display to prevent the incorrect display of humidity. In this connection, the evaporative humidifier 100 according to the present invention further comprises a program control unit (not shown) configured to ensure that sensing the external air humidity is only performed after the fan unit 1101 has been operating for a first period of time and/or the reading of the sensed external air humidity is frozen for a second period of time after the fan unit 1101 stops operating so as not to confuse the user by a sharply increment of the reading caused by the humidified air inside the evaporative humidifier 100.

Concretely, as shown in FIG. 7, the humidity is calculated in step 701 and displayed in step 702. Steps 703, 704, 705 and 706 are parts of the program to deal with the rise in humidity that occurs when the fan goes off. More concretely, step 703 performs a function of determining whether the fan is rotated for more than 10 minutes, if so return to the step 701; or else determine whether the humidity is lower than a setting value (step 704), if so return to the step 701, otherwise freeze the display (step 705) and then recalculate the humidity (step 706) and go back step 703.

The program control unit is further configured to automatically actuate the fan unit 1101 when the sensed external air humidity is lower than a preset humidity. As shown in FIG. 8, the functions of steps 801-810 are listed in a table 1 below, in which a speed 1 of the fan is larger than the speed 2.

TABLE 1

| steps | functions |
|---|---|
| 801 | switch on fan |
| 802 | pause for 10 minutes |
| 803 | determine whether the calculated humidity is lower than a setting value |
| 804 | determine whether a difference between the setting value and the calculated humidity is larger than 7 |
| 805 | rotate the fan at speed 1 |
| 806 | pause for 10 minutes |
| 807 | switch off the fan |
| 808 | determine whether the fan is off for more than 11 minutes |
| 809 | rotate the fan at speed 1 |
| 810 | rotate the fan at speed 2 |

Figure 5:
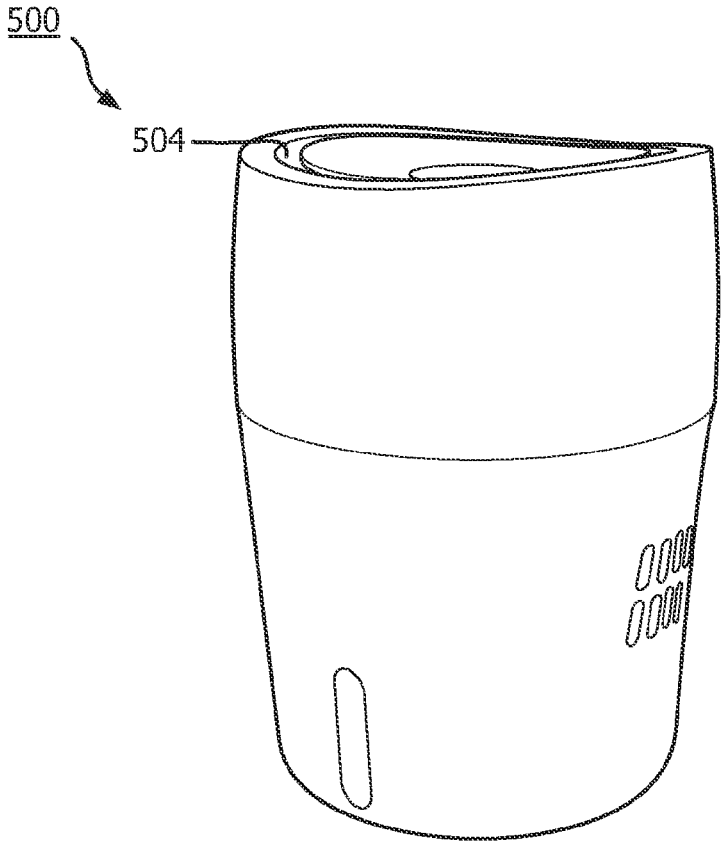
FIG. 5 is a finished product view of an evaporative humidifier according to an embodiment of the invention.
Figure 6:
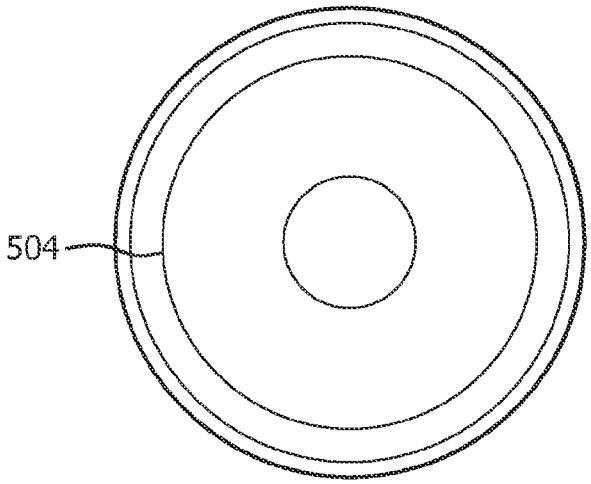
FIG. 6 is a schematic top view of FIG. 5.

In assembly and operation, firstly, water is poured into the water reservoir 1202. Secondly, the float 12013 and then the wick 12011 are mounted to the wick holder 12012, thus forming the wick unit 1201. Then, the wick unit 1201 is put into the water reservoir 1202, thus forming the lower portion 120 of the evaporative humidifier 100. Finally, the upper portion 110 of the evaporative humidifier 100 is assembled with the lower portion 120 of the the evaporative humidifier 100. FIGS. 5 and 6 are a finished product view of an evaporative humidifier 500 with an annular air outlet 504. Although the annular air outlet 504 shown in FIG. 5 is continuous, it should be understood that the annular air outlet 504 can be formed discretely or segmented.

As shown by arrows 140 in FIG. 1, in operation, the air out of the evaporative humidifier 100 is firstly sucked with the aid of the fan 11011 or convected into the ourter housing 130 of the evaporative humidifier 100. Most part of the air can then flow through the wick 12011 and carry humidity (moisture) into the fan housing 1102. Finally, the humidified air is blown through the annular air outlet 1104 with the aid of the aerodynamic design of the bottom wall 11031 of the top cover unit 1103, thus enhancing the humidity of a single room or an entire house.

Other advantages, effects and features of the evaporative humidifier 100 of the present invention shall be, alternatively or additionally, described in greater detail hereafter.

The evaporative humidifier 100 according the present invention has a straight sided fan housing 1102. As the fan 11011 spins it tends to concentrate the airflow at the outer edge of the fan housing 1102 and not in the centre of the fan housing 1102. At the fan housing edge, the air is flowing very fast in an upwards spiral. The optimum exit for the air is therefore the outer edge of the fan 11011 where the air is moving fastest. Thus in this invention a relatively small annular outlet 1104 for efficient air removal is created. The air from the fan 11011 is concentrated in this annular outlet at high exit velocity. This provides the following multiple benefits:

- the high exit velocity of spiraling air promotes of mixing of the humid air from the humidifier with the dry air in the room. This improves the even distribution of humidity in the room;
- low noise since we do not need to redirect the fast moving air at the edge of the fan to the middle of the fan using a grille (which would create an undesirable pressure drop potentially resulting in noise);
- only a small annular outlet is needed for the fan air as the air is already concentrated in this region, lots of space is available to mount a sophisticated user interface and PCB directly above the fan. Function buttons including automatic display of humidity level, timer functions, warnings about water level, and fan speed controls can all be mounted in the centre of the fan;
- the use of the annular spiral flow enables a large proportion of the cross sectional area to be used for a sophisticated user interface because a high velocity flow is concentrated at the outer edges; and
- when operating the user interface the users wrist is exposed above the high velocity air. This gives reassurance that the product is working efficiently.

Besides, it is usually not desirable to have any active components on the lower portion of the evaporative humidifier as the lower portion will be taken away and washed by the user. In order to achieve this, a float system has been developed in combination with the wick holder with a detection point for detecting the water level in the water reservoir setting at the upper portion of the evaporative humidifier. This system is very easy to assemble and disassemble by the user. This provides the following multiple benefits:

- the wick holder which holds the wick and the float can be easily removed by the user by just lifting it out of the water reservoir. Thus the overall lower portion is very easy to clean;
- the wick holder is heavy enough not to float when it experiences the buoyancy force from the float, so it does not need to be clipped into the housing of the lower portion. It just rests in the housing of the lower portion; and
- the float is preferably a simple plastic float that clicks into the wick holder. The float can be easily removed for cleaning. The wick holder limits the movement of the float so that it activates the actuator of the upper portion;
- the wick itself may be soft when wet so the removable wick holder gives the user a structure so that the wick can be easily removed and washed in place. Alternatively the wick can be easily slipped off the housing and cleaned;
- the wick holder itself is easily cleaned when the wick and the float are removed; and
- the wick holder also provides a feature to enable an anti-bacterial cartridge to be mounted in the lower container. The cartridge can be easily unclipped from the wick holder.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, number, and arrangement of parts within the principles of the invention to the full extent indicated by the broad general meaning of the terms in which the appended claims are expressed.

It should be noted that the abovementioned embodiments illustrate rather than limit the invention and that those skilled in the art would be able to design alternative embodiments without departing from the scope of the appended claims. For instance, to mount the user interface 1106, some mechanical mounting (not shown) across the exit path of the fan 11011 is necessary. However this can be achieved by three or so thin connecting bridges (not shown) that do not significantly impact the flow from the fan 11011.

In the claims, the word "comprising" does not exclude the presence of elements or steps not listed in a claim or in the description. The word "a" or "an" preceding an element does not exclude the presence of a plurality of such elements. In the apparatus claims enumerating several units, several of these units can be embodied by one and the same item of hardware or software. The usage of the words first, second and third, et cetera, does not indicate any ordering. These words are to be interpreted as names.

The invention claimed is:

1. An evaporative humidifier comprising:

a water reservoir;

a wick unit configured to absorb water from the water reservoir, wherein the wick unit comprises a wick, a wick holder for mounting the wick and a float arranged in the wick holder for associating with a water level in the water reservoir and the wick holder forms a substantially vertical guide along which the float is configured to move, the float clicks into the wick holder, and the wick holder is heavy enough to not float when it experiences a buoyancy force from the float; and a fan unit arranged within a fan housing and configured to force an air flow to flow through the wick unit, wherein the fan housing comprises a top cover unit defining at least one annular air outlet at an outer part adjacent a circumference of the top cover unit.

2. The evaporative humidifier according to claim 1, wherein a bottom wall of the top cover unit has an overall shape of an aerodynamic design for directing air in the fan housing to flow toward the annular air outlet when the fan rotates.

3. The evaporative humidifier according to claim 2, wherein the aerodynamic design is a streamline design of a convex shape.

4. The evaporative humidifier according to claim 1, wherein the fan unit comprises a motor and an actuator for actuating the motor, in operation the float is such arranged in the wick holder that it is buoyed by the water in the water reservoir so that the operation of the evaporative humidifier is controlled based on, at least in part, the water level in the water reservoir.

5. The evaporative humidifier according to claim 4, wherein the actuator is configured to remain the motor running for a period of time after the water level is below a water level threshold and then stop the motor.

6. The evaporative humidifier according to claim 4, wherein the actuator is:

a sensor-based actuator, which actuates the motor if the sensed height of the float is up to or higher than a predetermined height; or a contact component, which actuates the motor if the float collides the contacting component.

7. The evaporative humidifier according to claim 1, wherein a humidity sensor for sensing an external air humidity out of the humidifier is such arranged on an outer housing of the evaporative humidifier that it is separated from and not interfered by freshly humidified outgoing air.

8. The evaporative humidifier according to claim 7, further comprising a program control unit configured to ensure that sensing the external air humidity is only performed after the fan unit has been operating for a first period of time and/or the reading of the sensed external air humidity is frozen for a second period of time after the fan unit stops operating.

9. The evaporative humidifier according to claim 8, wherein the program control unit is further configured to automatically actuate the fan unit when the sensed external air humidity is lower than a preset humidity.

10. An indoor climate controlling system comprising the evaporative humidifier according to claim 1 and a main control unit coupled to the evaporative humidifier, wherein the main control unit is configured to automatically control the operation of the evaporative humidifier.

11. The evaporative humidifier according to claim 1, further comprising:

a user interface unit mounted on the top cover unit and surrounded by the annular air outlet.

* * * * *